US006942430B1

(12) United States Patent
Suver

(10) Patent No.: US 6,942,430 B1
(45) Date of Patent: Sep. 13, 2005

(54) ROTARY DRIVER FOR PIPE PILING

(75) Inventor: Paul W. Suver, 11025 14th Ave. South, Seattle, WA (US) 98168

(73) Assignee: Paul W. Suver, Seattle, WA (US)

( * ) Notice: Subject to any disclaimer, the term of this patent is extended or adjusted under 35 U.S.C. 154(b) by 0 days.

(21) Appl. No.: 10/799,903

(22) Filed: Mar. 10, 2004

(51) Int. Cl.[7] ..... E02D 7/22
(52) U.S. Cl. ..... 405/252.1; 405/232; 405/253
(58) Field of Search ..... 405/232, 242, 405/250, 251, 252, 252.1, 253, 254

(56) References Cited

U.S. PATENT DOCUMENTS

| | | | | | |
|---|---|---|---|---|---|
| 4,239,419 | A | * | 12/1980 | Gillen, Jr. | 405/232 |
| 4,708,530 | A | * | 11/1987 | Faber | 405/252 |
| 4,785,892 | A | * | 11/1988 | Luen | 173/28 |
| 4,911,581 | A | * | 3/1990 | Mauch | 405/232 |
| 5,544,979 | A | * | 8/1996 | White | 405/232 |
| 6,386,295 | B1 | * | 5/2002 | Suver | 405/232 |
| 6,524,032 | B2 | * | 2/2003 | Russell et al. | 405/251 |
| 6,641,332 | B1 | * | 11/2003 | Alvarado | 405/232 |
| 6,691,797 | B1 | * | 2/2004 | Hart | 405/232 |

FOREIGN PATENT DOCUMENTS

| | | | | |
|---|---|---|---|---|
| JP | 58204222 | * | 11/1983 | 405/253 |

* cited by examiner

*Primary Examiner*—Frederick L. Lagman
(74) *Attorney, Agent, or Firm*—Delbert J Barnard

(57) ABSTRACT

Apparatus for placing pipe piling (90, 90') in the ground including a support frame (10) and a motor (66) mounted on the support frame (10). The motor (66) has a downwardly extending rotary output shaft (68) which extends into an opening (70) in a drive head (76). Rotation of the output shaft (68) by the motor (66) will rotate the drive head (76) about a vertical axis. The drive head (76) is drivenly connectable to the upper end portion of the pipe piling (90, 90'). A clamping apparatus is mounted on lower side portions of the support frame. The clamping apparatus includes a pair of horizontally disposed linear hydraulic actuators (128). Each actuator comprises a fixed outer end portion (130) and a retractable/extendable/rotatable inner end portion (132). A pair of pipe piling engaging clamps (148, 150) are connected to the inner end portions (132) of the actuators (128). The clamps (148, 150) confront each other across space between them. The clamps (148, 150) are adapted to receive between them a section of the pipe piling (90, 90'). The actuators (128) can be retracted to move clamps (148, 150) apart and provide between them a pipe piling receiving space. The actuators (128) can be extended to move the clamps (148, 150) toward each other and into clamping engagement with a pipe piling (90, 90') that has been placed into space between the clamps (148, 150).

33 Claims, 9 Drawing Sheets

FIG. 2
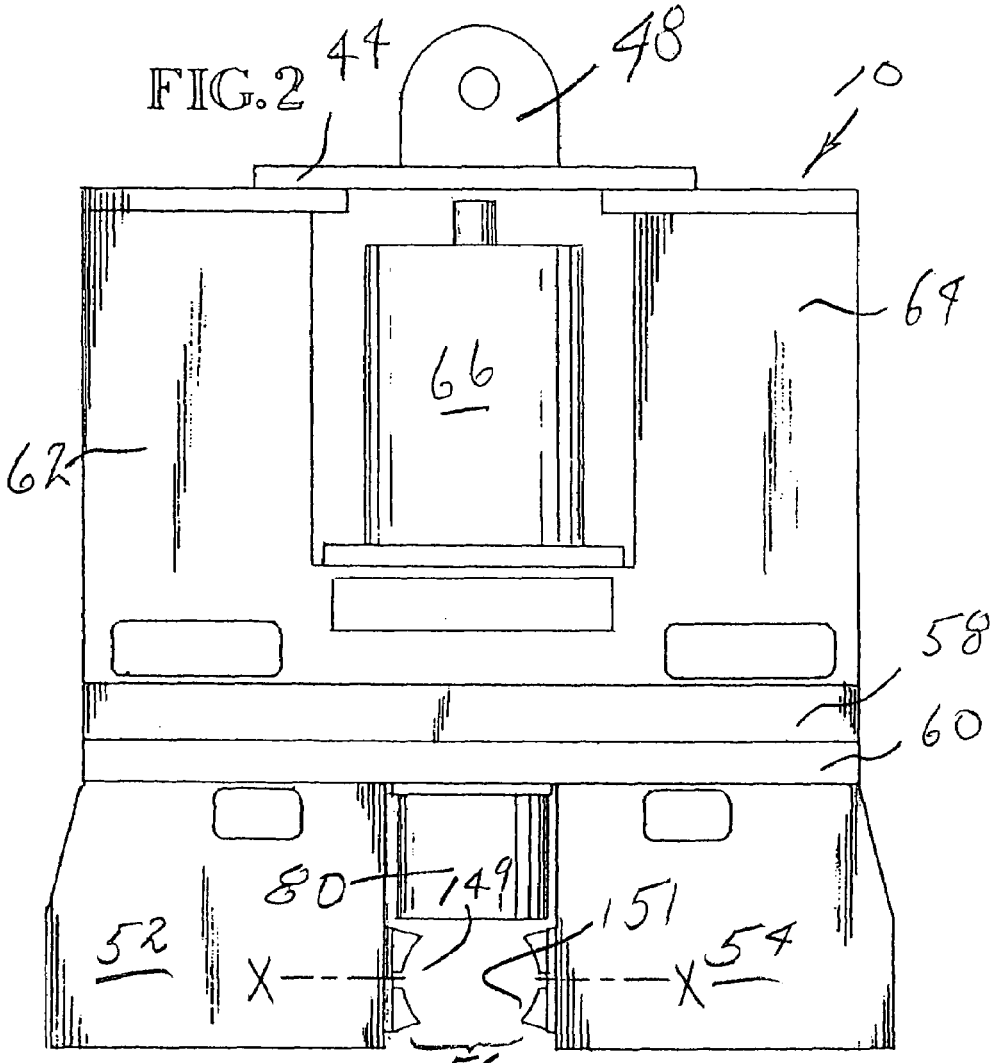
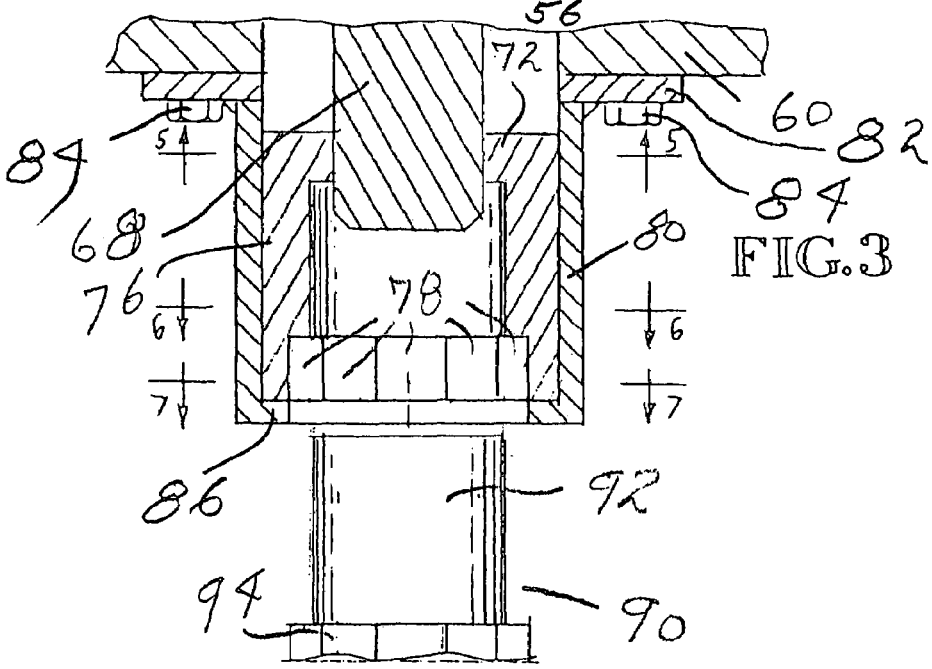
FIG. 3

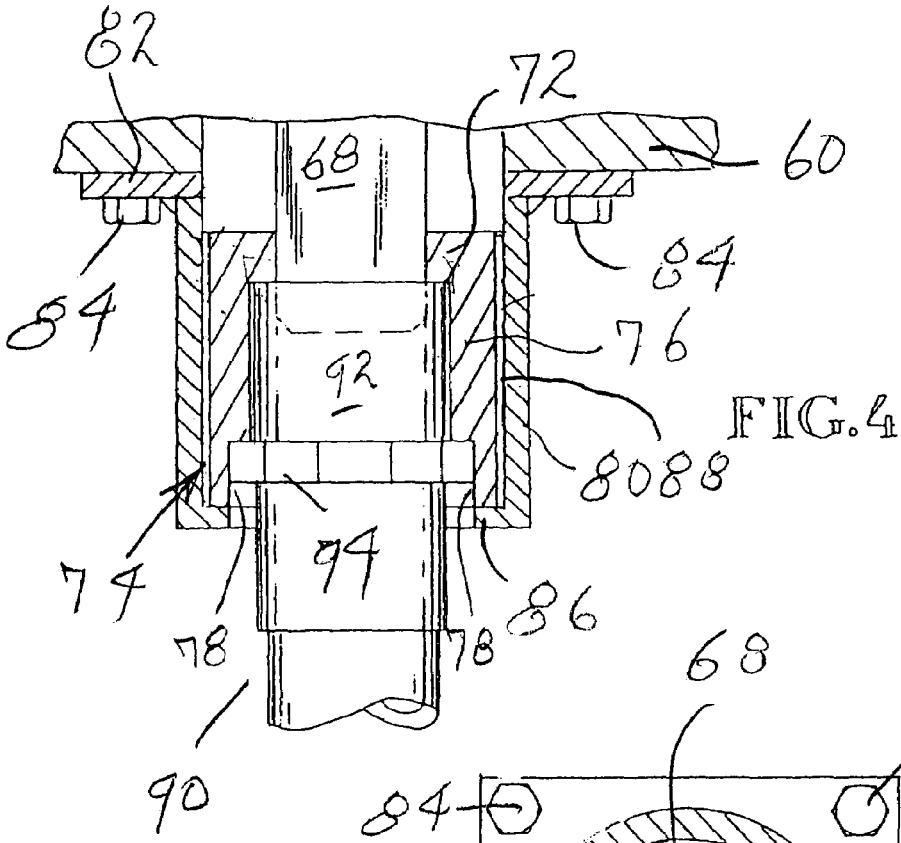
FIG. 4
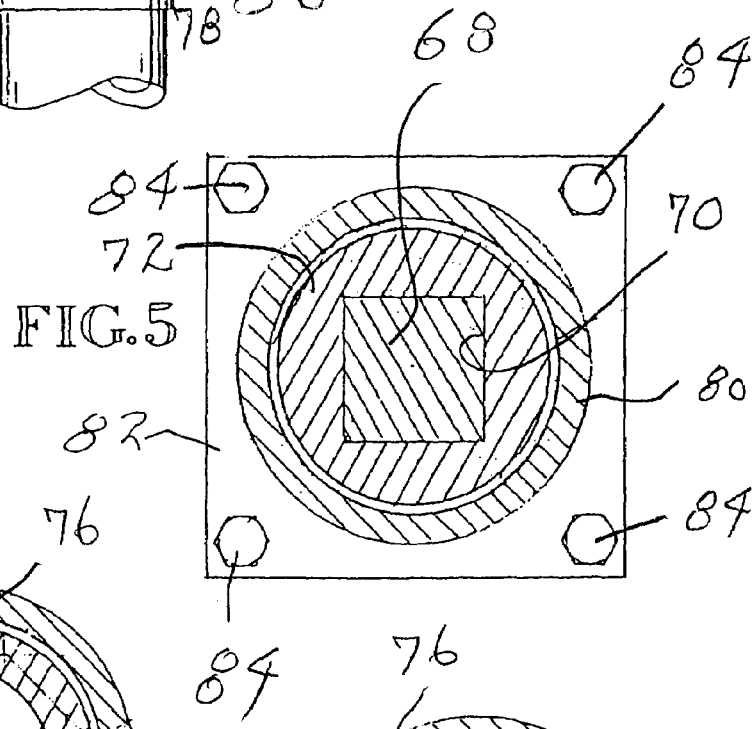
FIG. 5
FIG. 6
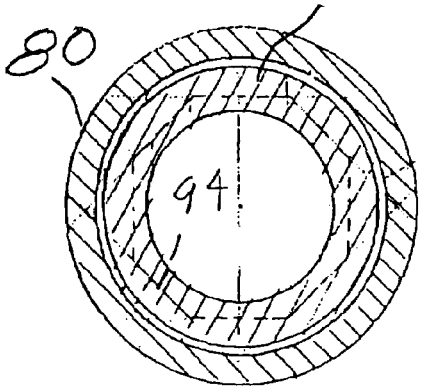
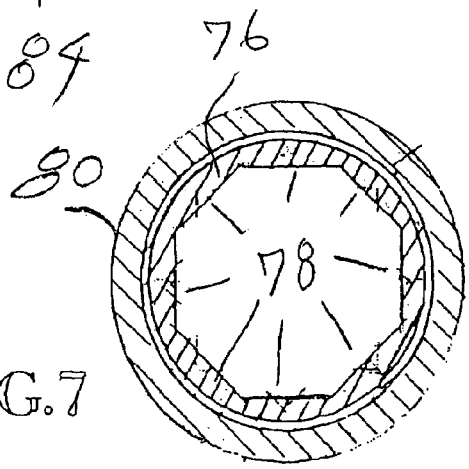
FIG. 7

FIG. 8
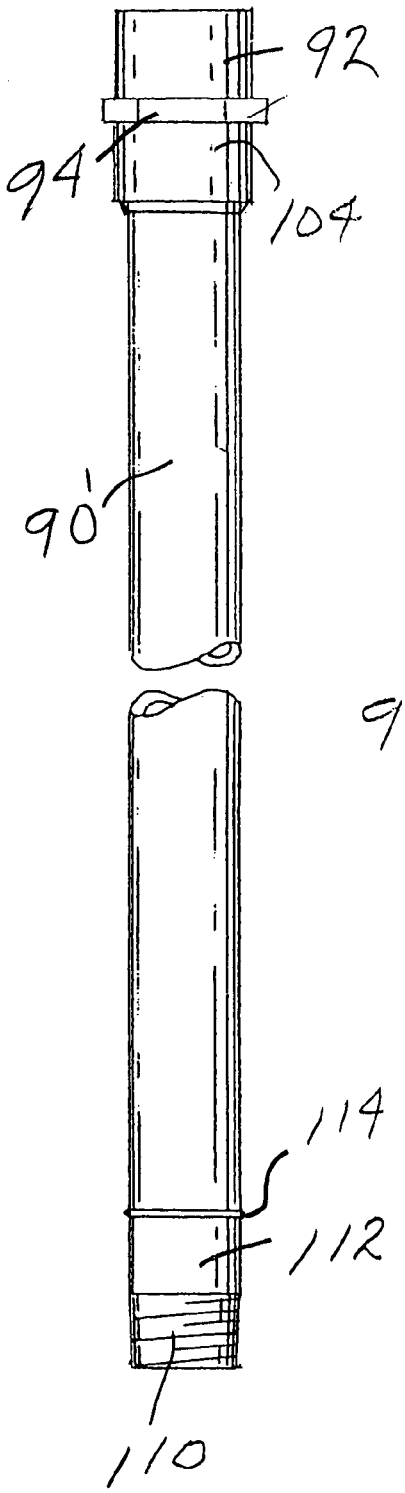
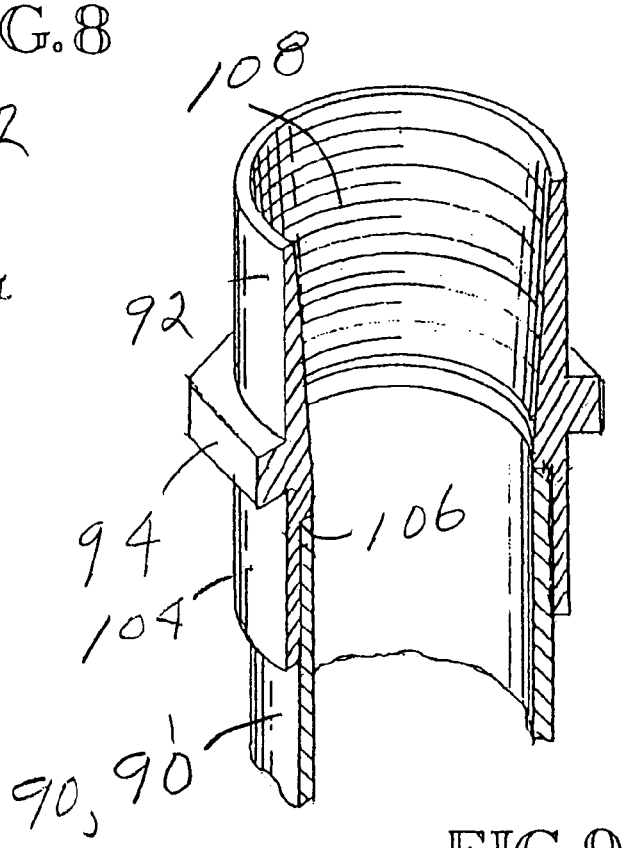
FIG. 9
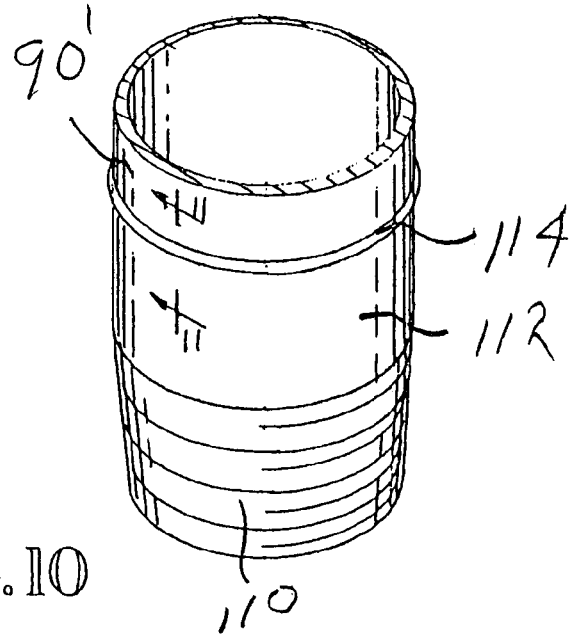
FIG. 10

ROTARY DRIVER FOR PIPE PILING

TECHNICAL FIELD

The present invention relates to apparatus for placing pipe piling in the ground. More particularly, it relates to the provision of (1) a pile driver that is adapted to be suspended from the boom of an excavator or some other overhead supporting device, (2) a pile driving machine that includes a mobile base, a boom connected to and extending upwardly from the mobile base, (3) a rotary drive head assembly that is suspended from the boom, to rotate the pipe piling and screw it into the ground and (4) a pile driving method.

BACKGROUND OF THE INVENTION

My U.S. Pat. No. 6,386,295, granted May 14, 2003, and entitled Vibratory Driver For Pipe Piling, includes in its background section an identification of other pile driving apparatuses that are in the patent literature. It also discloses an improved vibratory pile driver that is relatively simple and easy to operate but yet is effective to drive pipe pilings.

I have determined that it is desirable to place pipe piling in the ground by rotating instead of vibrating the pipe piling. There is a need for an improved mechanism for handling sections of pipe piling and placing them in the ground so that a pipe piling is created that is adequately anchored in the ground. An object of the present invention is to fulfil this need.

It is another object of the present invention to provide a quick and easy way of coupling the pipe piling to a drive head portion of the pile driving apparatus, and then decoupling the mechanisms from the pipe piling after the pipe piling has been placed into the ground. It is a further object of the present invention is to provide an improved way of handling sections of pipe piling and coupling them to a rotary drive head.

BRIEF DESCRIPTION OF THE INVENTION

The pile driving apparatus of the present invention is basically characterized by a pipe piling having an upper end portion and a lower end portion. A support frame is provided that includes a motor having a downwardly extending rotary output shaft. A drive head is mounted on the support frame for rotation about a vertical axis. The output shaft of the motor is connected to the drive head such that rotation of said output shaft by said motor will rotate the drive head about the vertical axis. The drive head is drivenly connectable to the upper end portion of the pipe piling. Clamping apparatus is mounted on side portions of the support frame, below said drive head. This clamping apparatus includes a pair of horizontally disposed linear hydraulic actuators. Each actuator comprises a fixed outer end portion and a retractable/extendable/rotatable inner end portion. A pair of pipe piling engaging clamps are connected to the inner end portions of the actuators. The clamps confront each other across a space that is between them. The clamps are adapted to receive in the space between them a section of pipe piling when the upper end portion of the pipe piling is drivenly connected to the drive head. The actuators can be retracted to move the clamps apart and provide between them said pipe piling receiving space. The actuators can be extended to move the clamps toward each other and into clamping engagement with a pipe piling that has been placed in the space between the clamps.

The pile driving apparatus of the present invention preferably includes a pipe piling having a threaded box at its upper end and wrench flats on the threaded box. A support frame is provided having a center portion and side portions flanking the center portion. A motor is mounted on the center portion of the support frame. The motor has a downwardly extending rotary output shaft. A drive head is mounted on the central portion of the support frame for rotation above the vertical axis. The output shaft of the motor is connected to the drive head such that rotation of the output shaft by the motor will rotate the drive head about the vertical axis. The drive head includes a downwardly opening socket wrench that is adapted for receiving and engaging the wrench flats on the pipe piling. A clamping apparatus is mounted on the side portions of the support frame below the drive head. The clamping apparatus includes a pair of horizontally disposed linear hydraulic actuators. Each actuator comprises a fixed outer portion and a retractable/extendable/rotatable inner end portion. A pair of pipe piling clamps are connected to the inner end portions of the actuators. The clamps confront each other across a space between them. The clamps are adapted to receive between them in said space a section of pipe piling that is below the wrench flats on the pipe piling when the wrench flats are in the socket wrench. The actuators are retracted to move the clamps apart and provide between them said pipe piling receiving space. Then, the actuators are extended to move the clamps towards each other and into clamping engagement with a pipe piling section that has been placed in the space between the clamps.

In preferred form, a ring surrounds the pipe piling below the threaded box. The wrench flats are provided on the ring. The ring includes at least four wrench flats equally spaced about the circumference of the ring. Preferably, the ring includes eight wrench flats equally spaced about the circumference of the ring.

According to an aspect of the invention, the socket wrench is in a first tubular member and the drive head includes a second tubular member surrounding the first tubular member. The first tubular member is housed within the second tubular member. The second tubular member has a radially inwardly projecting lower end flange and said inner tubular member has a lower edge that axially confronts the inwardly projecting lower end flange. The inner of first tubular member is axially movable up and down in the second or outer tubular member, relative to the lower end flange. In an embodiment of the invention, the first tubular member is both movable axially and is rotatable relative to the second tubular member. Preferably also, the output shaft of the motor has a non-secular cross section and the first tubular member includes a socket at its upper end that is sized and shaped to snugly receive the output shaft of the motor.

According to another aspect of the invention, the support frame includes a connection for connecting it to an overhead structure and the overhead structure is a part of the apparatus for placing the pipe piling in the ground. The support frame, the motor, the drive head and the clamping apparatus are all supported by the overhead structure.

In preferred form, the connection for connecting the support frame to the overhead structure is a universal joint.

According to yet another aspect of the invention, the support frame includes a horizontal beam section having a central portion and side portions flanking the central portion. The motor is mounted on the central portion of the beam section. The linear hydraulic actuators depend from the in portions of the beam section. The apparatus further includes an arch composed of arch side members having lower ends connected to the side portions of the beam section, and also having a top member interconnected between upper ends of the side portions of the arch above the motor. The connection for connecting the support frame to the overhead structure is mounted on the top portion of the arch.

In another embodiment of the invention, a threaded plug is provided in the threaded box at the upper end of the pipe piling. The threaded plug includes an opening that is sized to snugly receive the output shaft of the motor.

According to another aspect of the invention, the pipe piling has a lower end that includes augur flights for engaging the ground and moving the pipe piling downwardly into the ground in response to rotation of the pipe piling by the drive head.

Other objects, advantages and features of the invention will become apparent from the description of the best mode set forth below, from the drawings, from the claims, and from the principles that are embodied in the specific structures that are illustrated and described herein.

BRIEF DESCRIPTION OF THE SEVERAL VIEWS OF THE DRAWING

Like reference numerals refer to like parts throughout the several views of the drawing, and:

FIG. 2 is a an enlarged scale side elevational view of the pile driving attachment, such view showing a portion of a coupler above the attachment, a drive head, and a pair of gripping jaws below the drive head, adapted for receiving an upper end portion of a section of pipe piling;

FIG. 3 is an enlarged scale axial sectional view taken through the drive head, such view showing wrench flats near the upper end of a section of pipe piling and a socket and a socket wrench that are in the drive head;

FIG. 4 is a view like FIG. 3, but showing the upper end portion of the pipe piling in the socket and wrench flats engaged by the socket wrench;

FIG. 5 is a cross sectional view taken substantially along line 5—5 of FIG. 3.

FIG. 6 is a cross sectional view taken substantially along line 6—6 of FIG. 3;

FIG. 7 is a cross sectional view taken substantially along line 7—7 of FIG. 3;

FIG. 8 is an eleventional view of a section of pipe piling, with a center portion of the pipe broken away to indicate indeterminate length;

FIG. 9 is an enlarged scale fragmentary, sectional pictorial view of the upper end portion of FIG. 8;

FIG. 10 is an enlarged scale fragmentary view of the lower end portion of the section of pipe piling shown by FIG. 8;

DETAILED DESCRIPTION OF A PREFERRED EMBODIMENT OF THE INVENTION

Figure 1:
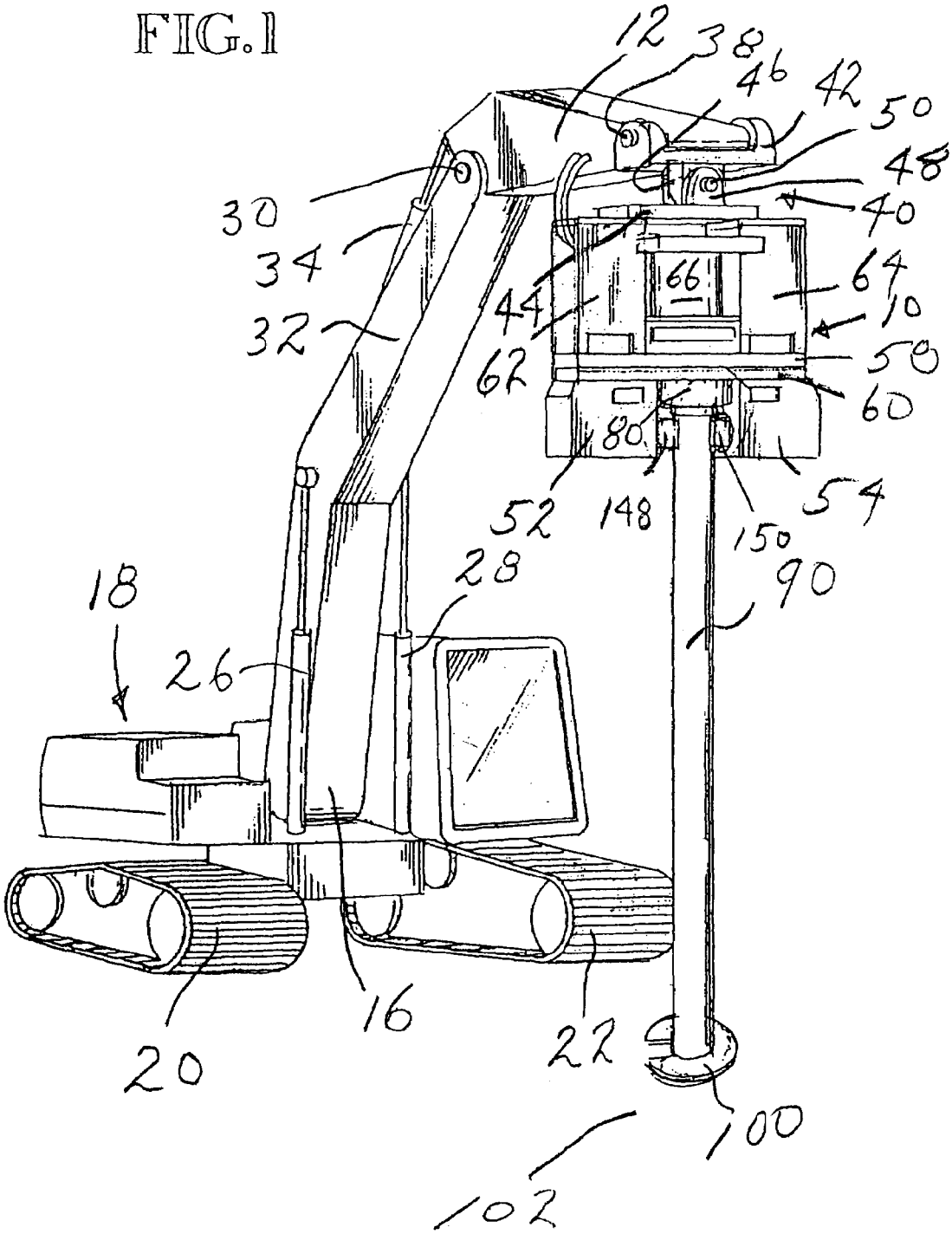
FIG. 1 is a pictorial view of an excavator and a pile driving attachment suspended from the boom of the excavator, such view showing the lower end of a lower section of pipe piling spaced above the ground.

Referring to FIG. 1, a rotary pile driver 10 is shown suspended from a forward section 12 of an articulated boom 14. Boom 14 includes a lower end portion 16 that is pivotally connected in conventional fashion to a mobile base 18. Base 18 may include a pair of laterally spaced apart tracks 20, 22. As is known per se, the tracks 20, 22 may be operated together to move the base 18 forwardly and rearwardly. Or, one track 20, 22 can be rotated in a first direction and the other track 20, 22 can be rotated in the opposite direction, for turning the base 18. A pair of hydraulic cylinders 26, 28 are interconnected between the base 18 and the boom 14. Extension of the cylinders 26, 28 acts to lift the boom 14 and retraction of the cylinders 26, 28 acts to lower the boom 14. Herein, "lift the boom 14" means swinging it upwardly about its pivotal connection to the base 18. "Lower the boom 14" means swinging the boom downwardly about its pivotal connection to the base 18.

Forward section 12 of the boom 14 is pivotally connected at 30 to the main portion 32 of the boom 14. A hydraulic cylinder 34 is interconnected between boom forward portion 12 and boom main portion 32. Extension of cylinder 34 causes the forward section 12 to swing downwardly relative to boom section 32. A retraction of cylinder 34 causes the forward section 12 to swing upwardly relative to the boom section 32. A bucket (not shown) or some other material handler may be pivotally connected to the forward boom section by a pivot pin 38, when the apparatus is used for excavating. The bucket in its placement on the boom section 12 is disclosed in the aforementioned U.S. Pat. No. 6,386,295.

The pile driver 10 is suspended from the forward boom section 12. It may be connected to the forward boom section 12 by a coupler 40. Having an upper section 42 that is connected to the boom section 12 by the bin 38 and a lower section 44 that is attached to the upper end of the pile driver 10. Coupler section 42 includes an ear 46 that is positioned between two ears 48, 49 on the lower portion 44. A pivot pin extends through the three ears 48, 46, 48. Together, the parts 38, 42, 44, 46, 48, 50 form a universal joint for the coupler 40.

As been shown by FIG. 2, the pile driver 10 has a two part lower portion 52, 54 which houses a rotatable chuck structure 56 that will hereinafter be described in some detail. Housing portions 52, 54 depend from a transverse beam which may be constructed from upper and lower plates 58, 60 that are welted or otherwise together. However, some other suitable beam structure may be used in place of plates 58, 60. A two part upper housing 62, 64 is positioned on the transverse beam structure 58, 60. Upper housing 62, 64 and top beam 44 together form an arch like structure that includes member 48 at its top and center. A drive motor 66 is positioned between the parts 62, 64 and is mounted at a central location above the transverse beam structure 58, 60. As shown by FIG. 3, an output shaft 68 extends outwardly from the motor 66. As best shown by FIG. 3, the output shaft 68 has a non-circular cross sectional shape, e.g., square. It fits into a complementary shaped opening 70 in the top wall 72 of a socket wrench 74. The socket wrench 74 has a tubular side wall 76 extending downwardly from top wall 72. Wrench flats 78 are provided at lower open end of the tubular wall 76. A second, outer tubular wall 80 surrounds tubular wall 76. It has a radial flange 82 at its upper end. Radial flange 82 is connected to the beam structure 58, 70 by bolts 84. The lower end of tubular wall 80 includes an inwardly directed radial lip 86 that confronts the lower end of tubular wall 76. As shown by FIG. 4, the lower end of tubular wall 76 will at times rest on the lip 82.

The inner tubular wall 76 is movable up and down within the outer tubular wall 80. Grease may be placed in the annular space 88 that is located between walls 76, 80. When member 72, 76 moves up and down within tubular member 80, member 76 slides up and down relative to output shaft 68.

Referring to FIG. 1, a pipe piling 90 is connected at its upper end 92 to the socket wrench that is formed by the socket wrench flats 78. The upper end portion of pipe piling 90 includes a surrounding ring 94 having wrench flats on its outer periphery which are complementary to the socket wrench flats 78. FIG. 4 shows the wrench flats 78 engaging the wrench flats 94. The upper end portion 92 of the pipe piling 90 projects into the inner tubular member 76 and extends upwardly until the external wrench flats 94 are inside of the internal wrench flats 78. When the wrench flats 70, 94 are engaged, rotation of the output shaft 68 will rotate tubular member 76 which will in turn rotate the pipe piling 90.

Figure 12:
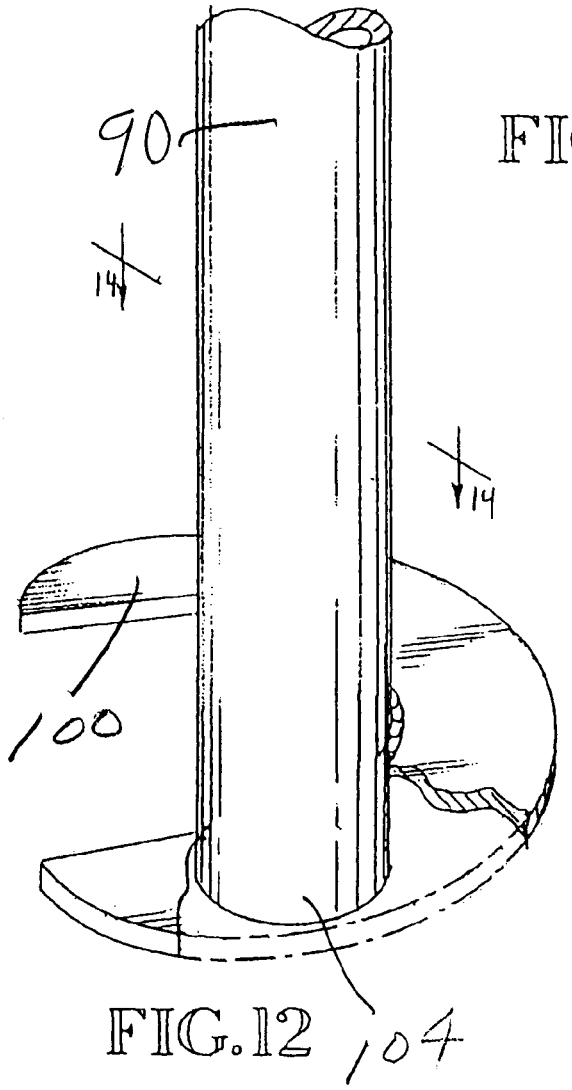
FIG. 12 is a fragmentary pictorial view of the lower end portion of FIG. 1, showing an augur at the lower end of the section of pipe piling, such view showing a foreground portion of the augur flight in phantom lines.
Figure 11:
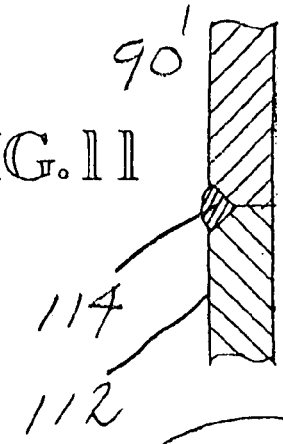
FIG. 11 is fragmentary sectional view taken substantially along line 11—11 of FIG. 10.
Figure 14:
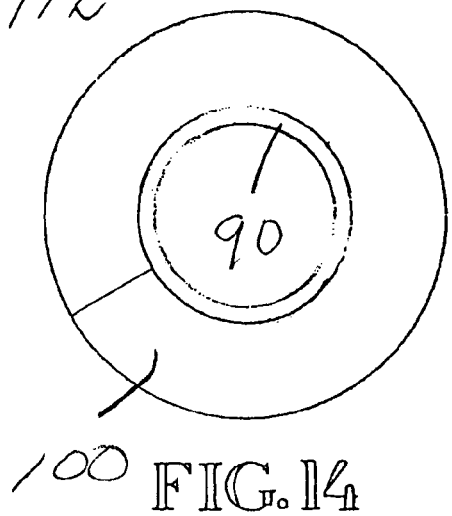
FIG. 14 is a bottom plan view of the section of pipe piling that is shown by FIG. 12.
Figure 13:
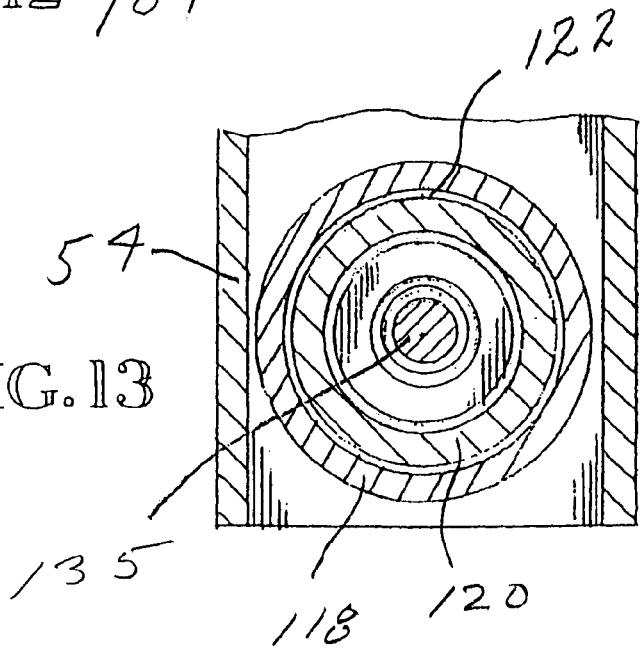
FIG. 13 is a sectional view taken substantially along line 13—13 of FIG. 15.

The pipe piling 10 may be a single member or it may be composed of a plurality of sections that are secured together in session. The single pipe piling 90 or the lower section of a sectional pipe piling includes augur flutes 100 that is heliac in shape and is adapted to bore itself into the ground material 102. As shown by FIG. 12, the lower end portion 104 of the pipe piling 90 may be a square cut end portion of the pipe piling 90. In preferred form, the upper end of the pipe piling 90 or pipe piling section 90' (FIG. 8) includes a tubular sub 104 into which the pipe piling 90, 90' extends (FIG. 9). The lower end portion of sub 104 receives the upper end portion of the member 90, 90'. A shoulder 106 may be formed inside of the end portion 104. In FIG. 9, the upper end of member 90, 90' is shown to abut against the shoulder 106. The upper end portion 92 of the sub 104 is internally threaded to form a threaded box 108. Each section of the pipe piling 90' above the first section 90 has a threaded pin 110 at its lower end. Pin 110 is formed on a second sub 112 that may be a short section of the pipe used to form the longer section 90'. The two sections may be abutted together where they meet and a welt bead 114 may be used to connect the two sections together. See FIG. 11. A construction of the pipe piling used in these subs 104, 112 is more economical than machining ends onto a long piece of pipe. As shown on the several figures of the drawing, the ring 94 that includes that external wrench flats are formed on the sub 104.

Figure 15:
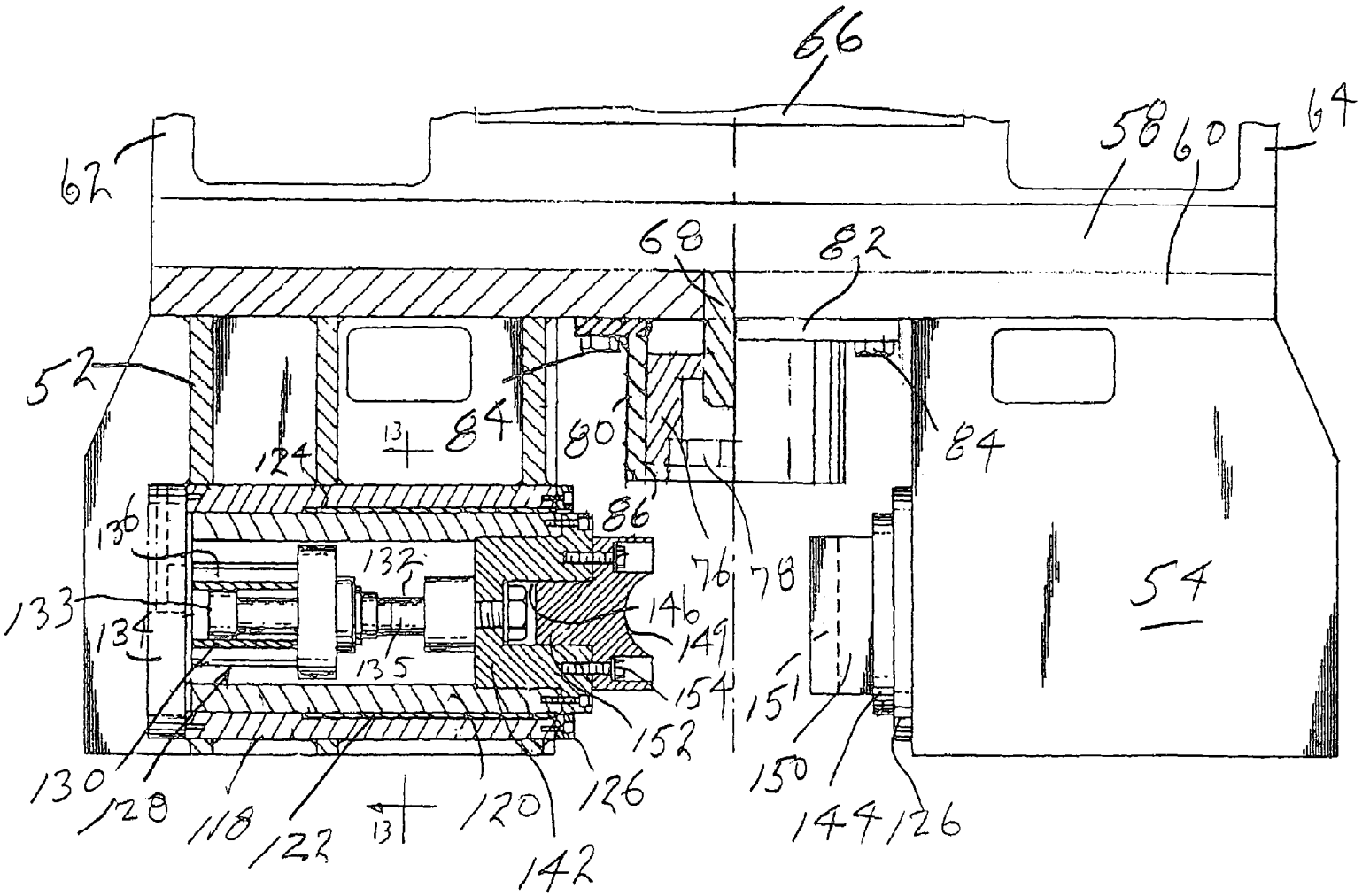
FIG. 15 is an enlarged scale fragmentary view of the lower portion of the drive head showing some parts in section and others in elevation.

The lower portion of FIG. 15 is like FIG. 4 in U.S. Pat. No. 6,386,295 except for the inclusion of the socket wrench in FIG. 15 and its exclusion in FIG. 4 of U.S. Pat. No. 6,386,295. U.S. Pat. No. 6,386,295 is hereby incorporated herein by this specific reference.

Referring to FIG. 15, the housing portions 52, 54 are shown to include a pair of substantially identical tubular members 118, one of which is shown in sections in FIG. 15. A smaller tubular member 120 fits within the tubular housing 118. A tubular bearing 122 fits inside of tubular member 118, between it and tubular member 120. As shown in FIG. 15, a substantial portion of the tubular housing 118 may be machined to give it an inner diameter that is larger than the inner diameter of the remaining portion of member 118. This inner diameter is also larger than the outside diameter tubular member 120. This forms an annular space in which the bearing sleeve 122 is received (FIG. 15). A radial surface or shoulder 124 is formed between the smaller portion of tubular member 18, shown on the left in FIG. 15, and the larger diameter portion, shown on the right in FIG. 15. The inner end of the tubular bearing 122 abuts this shoulder 124. A retaining ring 126 abuts the opposite end of the bearing sleeve 122. A linear hydraulic motor 128 is housed within the tubular housing 120. Hydraulic Motor 128 includes an outer end portion 130 and an inner end portion 132. In the illustrated embodiment, the outer end portion 130 is a cylinder. The inner end portion 132 is a piston. Piston 132 includes a piston head 133 within the cylinder 130 and a piston rod 135 that projects from the piston head 133 outwardly from the cylinder 130. The piston rod 135 is extendable and retractable relative to the cylinder 130. As shown by FIG. 15, the cylinder includes a radial end wall 134 and a tubular side wall 136. The end wall 134 is of a diameter substantially equal to the diameter of tubular member 118. It is removably secured to the end of tubular member 118 by screw fasteners. The screw fasteners extend through screw openings and screw into threaded openings in the rear end of tubular housing 118. The screw fasteners secure the end wall 138 to the tabular housing 118, thus fixing the outer end portion of the linear hydraulic motor 128 to a fixed portion of the frame. The inner end portion 132 of the linear hydraulic motor 128 is connected to a head member 142 that in turn is connected to inner tubular member 120. As a result of this connection, inner tubular member will extend and retract together with piston 132 and the member 142. In FIG. 15, the linear hydraulic motor 128 is shown on its fully retracted position. When hydraulic fluid is delivered into the base chamber at the end of the linear hydraulic motor 128, and removed from the piston rod chamber, the piston and piston rod will extend. They will move to the right (extend) from the position shown in FIG. 4. The inner tubular member 120 will move with them because the end member 142 is connected to both the piston rod and the tubular housing 120. As it moves in and out, the tubular housing 120 slides within the sleeve bearing 122. The member 142 and the tubular inner housing 120 can also rotate in position together with the piston head 133 and the piston rod 135. The piston rod 135 extends out through a seal at the end of the cylinder housing. There is nothing that restrains the piston head 133 and the piston rod 134 from rotating within the cylinder housing when and if a force is applied on them that would tend to make them rotate.

The above description of the coupler end portion within housing 52 applies equally as well to the coupler end portion that is in housing portion 54. This is because the fact that the two coupler end portions are identical. Each includes an end member 142, 144. The end members 142, 144 include coaxial sockets. The socket in end member 142 is designated 146. The sockets receive pins that are at the inner ends of grip jaws 148, 150. The pin for grip jaw 148 is designated 152 in FIG. 15. Grip jaws are inserted into the sockets and grip jaws are connected to the heads 142, 144, by means of a series of bolts 154.

Figure 16:
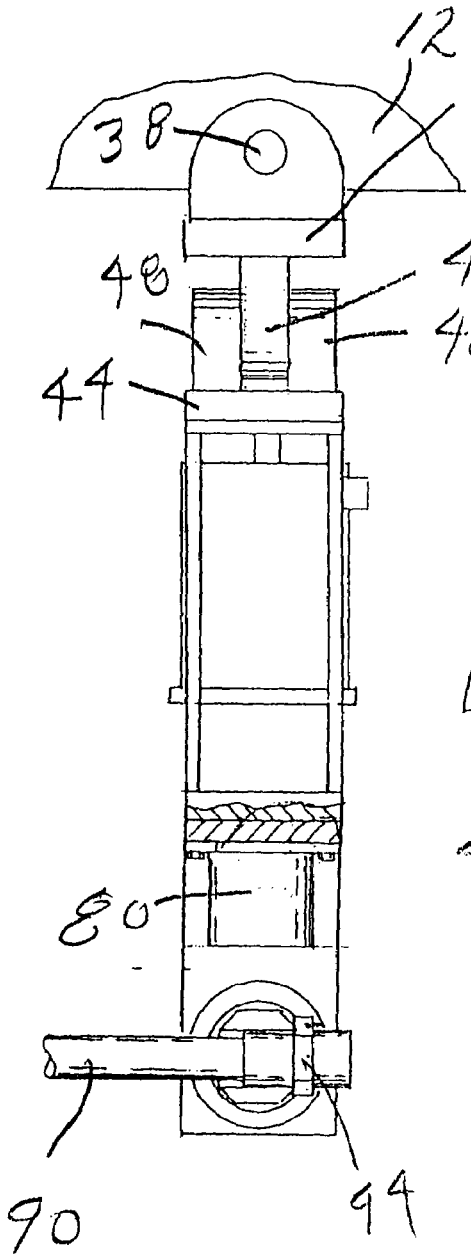
FIG. 16 is a fragmentary view, partially in section and partially in elevation, showing the pile driving and attachment in the process of picking up a section of pipe piling.
Figure 17:
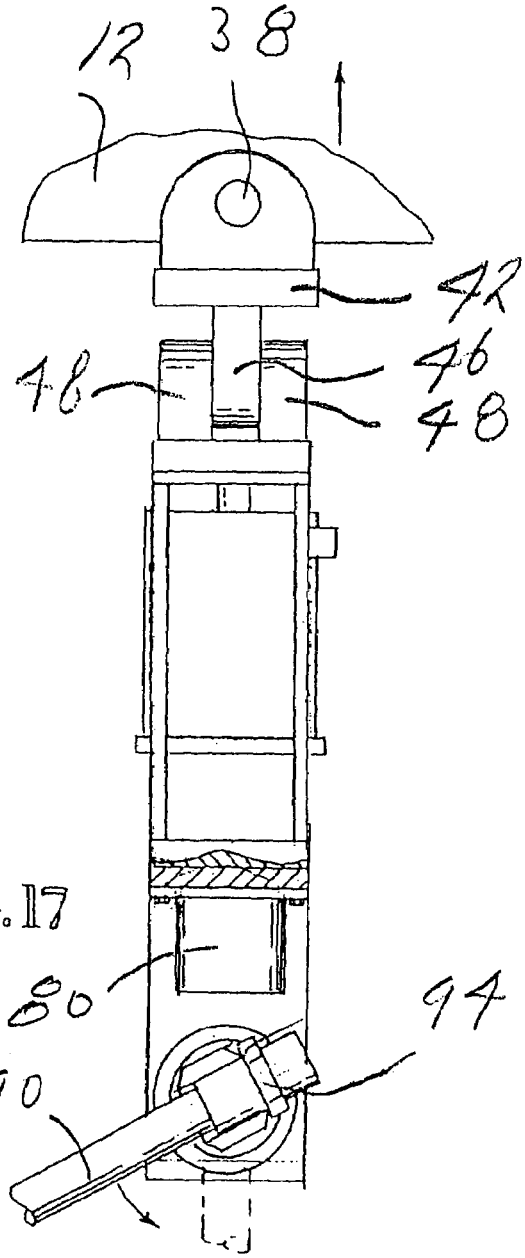
FIG. 17 is a view like FIG. 16, but showing the boom of the excavator and the pile driving attachment moved upwardly, and further showing the pipe piling in a sloping postion and the clamping jaws rotated to permit the position change of the pipe piling.
Figure 18:
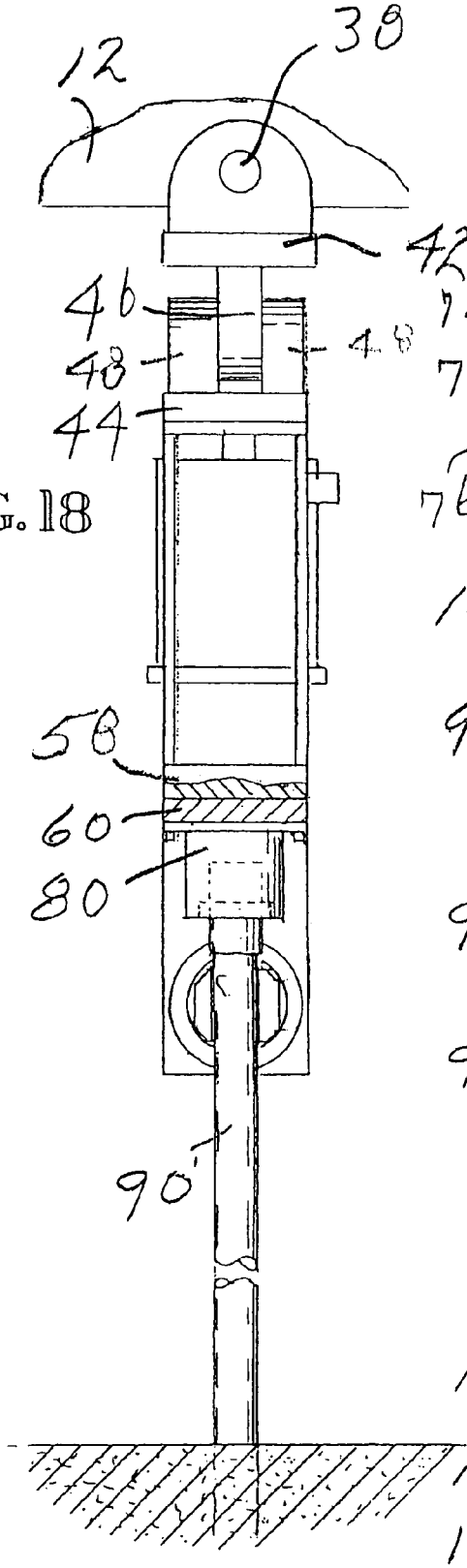
FIG. 18 is a view like FIGS. 16 and 17, but showing the excavator boom in a higher position and showing the pipe piling in a vertical position, moved upwardly to where its upper end is within the drive head, and further showing the clamping jaws rotated further to permit the pipe piling to extend vertically.
Figure 19:
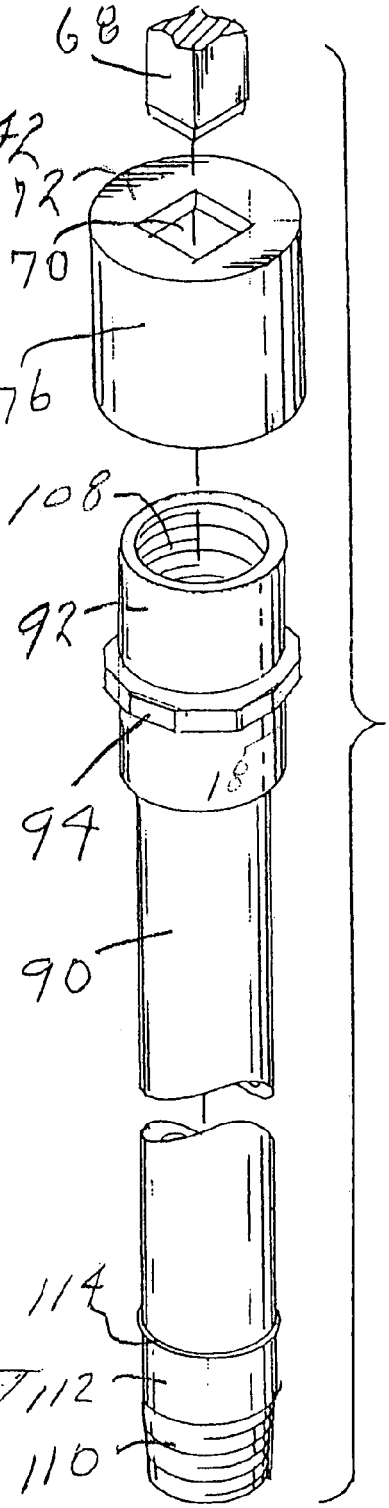
FIG. 19 is an exploded pictorial view of the pipe piling section shown by FIG. 8, positioned below a tubular that is a portion of the drive head and includes a socket for receiving the upper end portion of the pipe piling section and a socket wrench for engaging the wrench flats on the pipe piling, and a drive shaft positioned above the drive head and including a non-circular cross section that is fitable in a non-circular socket formed in the upper end portion of the drive head member.

Referring now to FIGS. 16–18, FIG. 16 shows a pipe piling 90, 90' in a substantially horizontal position. It also shows an upper end portion of the pipe piling engaged by clamp jaws 148, 150. Clamp jaw 150 is shown in this view but clamp jaw 148 is not. It is necessary that the end portion of the pipe piling 90 be elevated in some manner. Pipe piling 90, 90' may be on top of a stack of pipe pilings 90, 90'. In that case, it may be moved end wise until the end portion is over hanging the rest of the pipe stack. Then, the coupler assembly is lowered until the end portion of the pipe piling is between the two jaws 148, 150.

When the hydraulic motors are retracted, the jaws 148, 150 are spaced apart so as to define between them a space for receiving an end portion of the pipe piling 90, 90'. Also, the jaws 148, 150 are rotated such that their pipes engaging recesses 149, 151 are parallel to each other and to the pipe piling 90, 90'. In FIG. 15, the jaw 148 and its recess 149 is oriented to engage a pipe piling 90, 90' that is substantially horizontal oriented. The jaw 150 and its recess 151 are oriented to engage a pipe piling 90, 90' that is substantially vertically oriented. As described above, jaws 148 150 are rotatable with the head members 142, 144 and the piston components to which the head members 142, 144 are connected.

The coupler assembly is moved to position a pipe piling end portion in line with the two recesses 149, 151. Then, the liner hydraulic motors 128 are extended to move the jaws 148, 150 together. This moves the recesses 149, 151 into clamping engagements with the pipe piling end portion. This is the orientation and relationship that are shown in FIG. 16. Next, the operator lifts the boom section 12 to in turn lift the coupler assembly. As the coupler assembly moves upwardly, it carries with it the griped end portion of the pipe piling 90. This lifts of the end portion, while the opposite end of the pipe piling remains supported, causing the pipe piling 90, 90' to move from a substantially horizontal orientation to a sloping orientation. An early state of this sloping orientation is shown by FIG. 17. Because the clamp jaws 148, 150 are able to rotate, they will rotate together as the pipe piling 90, 90' moves upwardly.

The weight of the pipe piling 90, 90' will act a hold in its second end downwardly as the upper end moves upwardly. The boom 14, and in particular the boom section 12, are moved upwardly until the pipe piling 90, 90' is in a substantially vertical orientation and is suspended from the clamp jaws 148, 150 (FIG. 18). Then, the assembly is lowered until the lower end of the pipe piling 90, 90' is resting on and/or is supported by the ground 102. At the same time, the upper end portion 92 of the pipe piling 90, 91' enters into the tubular member 76 and the wrench-flat ring 94 enters into the wrench-flat socket at the bottom of the member 76. When the wrench flats 78 have fully engaged the wrench flats on the ring 94, the main motor 66 can be rotated to in turn rotate the member 76 and the pipe piling 90, 90' connected to it by the two sets of wrench flats. Rotation of the pipe piling 90, 90' causes the augur section 100 to bore into the ground 102, pulling with it the pipe piling 90, 90'. At the same time, the boom 12, 32 is lowered and the crawler base 18 is moved to the extent necessary to allow the socket wrench to move downwardly with the pipe piling section 90, 90'.

Motor 66 will be used to rotate the pipe piling 90, 90' until its upper end is closely adjacent to the top of the ground 102. Then, the grip jaws 48, 150 are retracted and the boom 32 is lifted to separate the pile driver 10 from the pipe piling 90, 90' that is in the ground. When the pipe piling is sectional, a first section 90 that is first screwed into the ground, then, the machine is moved over to pick up a second section 90' that has a threaded pin 110 at its lower end. This section 90' is picked up by the jaws 148, 150, with the upper end portion 92 inside the tubular member 76 and the wrench flat ring 74 inside of the socket wrench formed by the wrench flats 78. Then, the clamp jaws 148, 150 are extended to grip the pipe piling section 90'. Then, the machine is operated to pick up the section 90' and move it over until the threaded pin 110 at its lower end is at alignment with the threaded box 108 in the pipe piling section 90 that is in the ground. When pin 110 is mated with box 108, pipe piling section 90' is rotated so as to screw the pipe piling section 90' to the pipe piling section 90. When the two sections 90, 90' are joined, rotation is continued to cause rotation of both pipe sections 90, 90' and an operation of the augur section 100 to screw them both into the ground. Once the pipe piling section 90 is substantially in the ground, the clamp jaws 148, 150 are retracted and the pile driver 10 is lifted up and away from pipe piling section 90'. It can then be used to pick up a third section of pipe piling (now shown) and add it to section 90'. This procedure can be repeated until a desire amount of pipe piling sections 90, 90' are in the ground.

Figure 20:
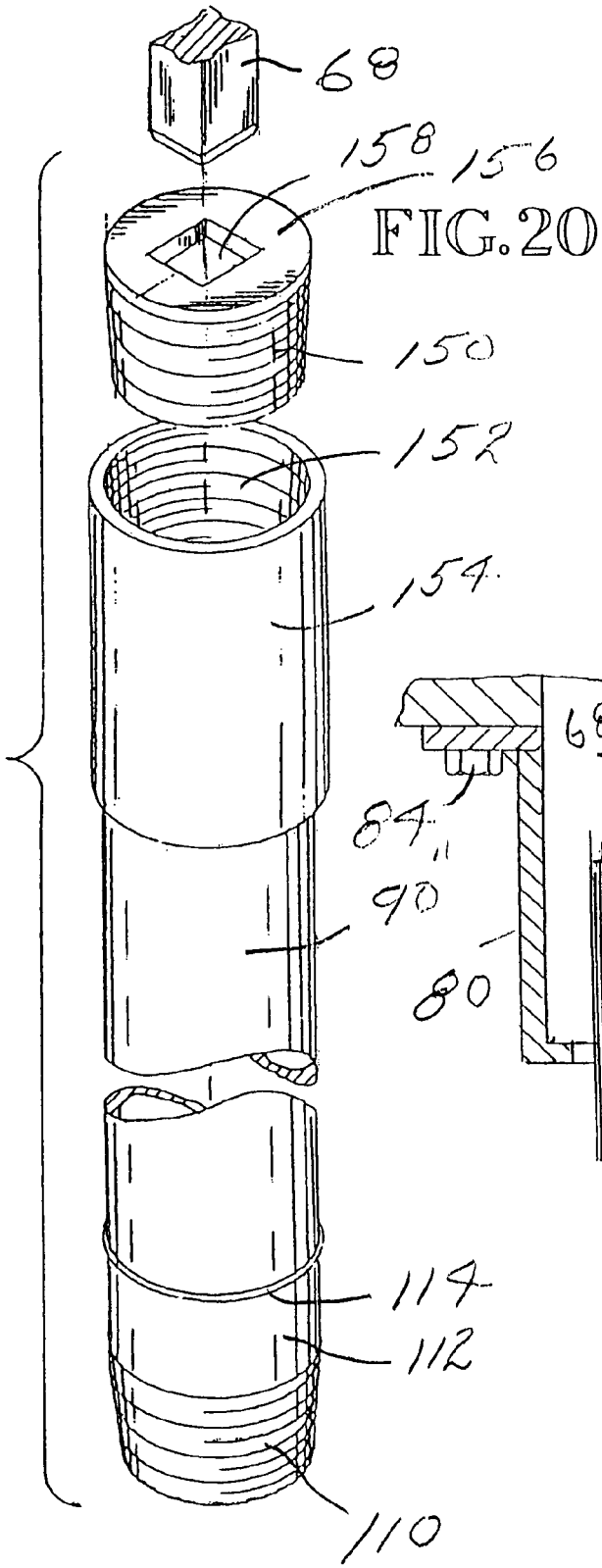
FIG. 20 is a view like FIG. 19 but showing a modified construction of the apparatus that connects the output shaft of the motor to the upper end portion of the pipe piling, such an embodiment showing a threaded plug that screws into a threaded box at the upper end portion of the pipe piling, said threaded plug including a non-circular socket that engages a non-circular shaft that depends from the drive motors.
Figure 21:
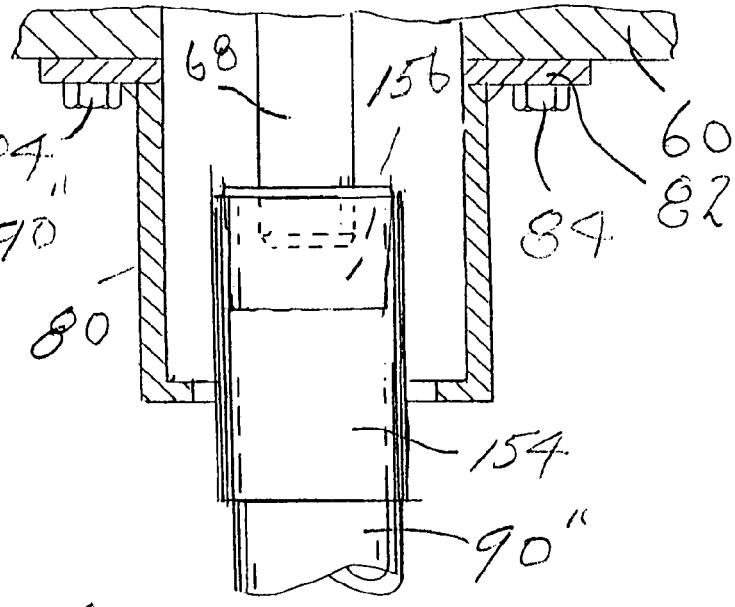
FIG. 21 is a view like FIG. 3 but of the embodiment shown by FIG. 20.

FIGS. 20 and 21 show a modified construction of the connection between the drive shaft 68 and a pipe piling section 90". In this embodiment, a plug 150 is screwed into threaded box 152 formed in the upper end portion of a sub 154 that is welted or otherwise suitably connected to the pipe piling 90". In this embodiment, sub 154 does not include the wrench flat ring 92. Rather, the upper end 156 of plug 150 includes an opening 158 that is sized and shaped to receive the drive shaft 68. When the drive shaft 68 is inside the opening 158, and the motor 66 is rotated, the drive shaft 68 well rotate the plug 150 and plug 150 will rotate the pipe piling section 90". This is because the drive shaft 68 is rotated in the same direction that is was rotated for the purpose of screwing plug 150 into the threaded box 152.

The illustrated embodiment represents a single example of the present invention and, therefore, is non-limitive. It is to be understood that many changes in the particular structure, materials, and features of the invention may be made without departing from the spirit and scope of the invention. Therefore, my patent rights are not to be limited by the particular embodiment that is illustrated and described herein, but rather is be determined by the following claims, interpreted according to accepted doctrines of patent claim interpretation, including use of the doctrine of equivalents.

What is claimed is:

1. Apparatus for placing pipe piling in the ground, comprising:

pipe piling having an upper end portion and a lower end portion;

a support frame;

a motor mounted on said support frame, said motor having a downwardly extending rotary output shaft;

a drive head mounted on said support frame for rotation about a vertical axis;

said output shaft being connected to said drive head such that rotation of said output shaft by said motor will rotate the drive head about said vertical axis;

said drive head being drivenly connectable to the upper end portion of the pipe piling;

clamping apparatus mounted on side portions of the support frame, below said drive head, said clamping apparatus including:

a pair of horizontally disposed linear hydraulic actuators, each said actuator comprising a fixed outer end portion and a retractable/extendible/rotatable inner end portion; and a pair of pipe piling engaging clamps connected to the inner end portions of the actuators, said clamps confronting each other across a space between them, said clamps being adapted to receive between them a section of pipe piling when the upper end portion of the pipe piling is drivenly connected to said drive head;

whereby the actuators can be retracted to move the clamps apart and provide between them said pipe piling receiving space, and the actuators can be extended to move the clamps towards each other and into clamping engagement with a pipe piling that has been placed in said space between the clamps.

2. The apparatus of claim 1, wherein said upper end portion of said pipe piling includes a ring surrounding the pipe piling, wherein wrench flats are provided on said ring, and wherein said drive head includes a socket for engaging the upper end portion of said pipe piling and a socket wrench in said socket for engaging said wrench flats, to drivenly connect the drive head to the upper end portion of the pipe piling.

3. The apparatus of claim 2, wherein the ring includes at least four wrench flats equally spaced about the circumference of the ring.

4. The apparatus of claim 2, wherein the ring includes eight wrench flats equally spaced about the circumference of the ring.

5. The apparatus of claim 2, wherein the socket and socket wrench are formed in a first tubular member and the drive head includes a second tubular member surrounding the first tubular member in which the first tubular member is housed.

6. The apparatus of claim 5, wherein the second tubular member has a radially inwardly projecting lower end flange and said inner tubular member has a lower edge that axially confronts the inwardly projecting lower end flange, and wherein said first tubular member is axially movable up and down in said second tubular member relative to the lower end flange.

7. The apparatus of claim 6, wherein the first tubular member is movable axially and is rotatable relative to the second tubular member.

8. The apparatus of claim 7, wherein the output shaft of the motor has a non-circular cross section and the first tubular member includes a socket at its upper end that is sized and shaped to snugly receive the output shaft of the motor.

9. The apparatus of claim 1, wherein the support frame includes a connection for connecting it to an overhead structure and the apparatus includes the overhead structure, and wherein the support frame, the motor, the drive head and the clamping apparatus are all supported by the overhead structure.

10. The apparatus of claim 9, wherein the connection for connecting the support frame to the overhead structure includes a universal joint.

11. The apparatus of claim 1, wherein the support frame includes a horizontal beam section having a center portion and side portions flanking the center portion, said motor is mounted on the center portion of the beam section, said linear hydraulic actuators depend from the end portions of the beam section, and said apparatus includes an arch composed of arch side members connected at the lower ends to the side portions of the beam section and having a top member interconnecting upper ends of the side portions of the arch above the motor, and wherein the connection for connecting the support frame to an overhead structure is mounted on the top portion of the arch.

12. The apparatus of claim 1, wherein the lower end portion of said pipe piling includes an augur for engaging the ground and screwing the pipe piling downwardly into the ground in response to rotation of the pipe piling by the drive head.

13. The apparatus of claim 12, including a ring surrounding the upper end portion of the pipe piling and wrench flats on said ring, and wherein said drive head includes, a socket wrench for engaging said wrench flats to drivenly connect the drive head to the pipe piling.

14. The apparatus of claim 12, wherein the pipe piling is composed of a plurality of sections that are connected together, wherein each upper section has a lower end that includes a threaded pin and each lower section includes an upper end that includes a threaded box for engaging the threaded pin of the section above it.

15. The apparatus of claim 14, wherein the pipe piling includes a bottom section on which the said augur is formed.

16. The apparatus of claim 1 wherein the upper end of the pipe piling includes a threaded box, wherein a threaded plug is screwed into said box and the threaded plug is connected to the output shaft of the drive motor.

17. The apparatus of claim 16 wherein the output shaft of the motor has a non-circular cross section and the threaded plug includes a socket at its upper end that is sized and shaped to snugly receive the output shaft of the motor.

18. Apparatus for placing pipe piling in the ground, comprising:

pipe piling having a an upper end portion including a threaded box and exterior wrench flats;

a support frame having a center portion and side portions flanking the center portion;

a motor mounted on the center portion of said support frame, said motor having a downwardly extending rotary output shaft;

a drive head mounted on the central portion of said support frame for rotation about a vertical axis;

said output shaft being connected to said drive head such that rotation of said output shaft by said motor will rotate the drive head about said vertical axis;

said drive head including a downwardly opening socket for receiving the upper end portion of the pipe piling;

a wrench section in said socket for engaging the wrench flats on the pipe piling when the upper end portion of the pipe piling is in the socket;

clamping apparatus on the side portions of the support frame below said drive head, said clamping apparatus including:

a pair of horizontally disposed linear hydraulic actuators, each said actuator comprising a fixed outer end portion and a retractable/extendible/rotatable inner end portion; and a pair of pipe piling engaging clamps connected to the inner end portions of the actuators, said clamps confronting each other across a space between them, said clamps being adapted to receive between them a section of pipe piling that is below the wrench flats on the pipe piling when the upper end portion of the pipe piling is in the socket;

whereby the actuators can be retracted to move the clamps apart and provide between them said pipe piling receiving space, and the actuators can be extended to move the clamps towards each other and into clamping engagement with a pipe piling that has been placed in said space between the clamps.

19. The apparatus of claim 18, including a ring surrounding the pipe piling and wrench flats on said ring.

20. The apparatus of claim 19, wherein the ring includes at least four wrench flats equally spaced about the circumference of the ring.

21. The apparatus of claim 19, wherein the ring includes eight wrench flats equally spaced about the circumference of the ring.

22. The apparatus of claim 18, wherein the drive head includes a first tubular member, wherein the drive head includes a second tubular member surrounding the first tubular member in which the first tubular member is housed, and wherein the first tubular member includes the wrench section.

23. The apparatus of claim 22, wherein the second tubular member has a radially inwardly projecting lower end flange and said inner tubular member has a lower edge that axially confronts the inwardly projecting lower end flange, and wherein said first tubular member is axially movable up and down in said second tubular member relative to the lower end flange.

24. The apparatus of claim 23, wherein the first tubular member is movable axially and is rotateable relative to the second tubular member.

25. The apparatus of claim 24, wherein the output shaft of the motor has a non-circular cross section and the first tubular member includes a socket at its upper end that is sized and shaped to snugly receive the output shaft of the motor.

26. The apparatus of claim 18, wherein the support frame includes a connection for connecting it to an overhead structure and the apparatus includes the overhead structure, and the support frame, the motor, the drive head and the clamping apparatus are all supported by the overhead structure.

27. The apparatus of claim 26, wherein the connection for connecting the support frame to the overhead structure includes a universal joint.

28. The apparatus of claim 18, wherein the support frame includes a horizontal beam section having a center portion and side portions flanking the center portion, said motor is mounted on the center portion of the beam section, said linear hydraulic actuators depend from the end portions of the beam section, and said apparatus includes an arch composed of arch side members connected at the lower ends to the side portions of the beam section and having a top member interconnecting upper ends of the side portions of the arch above the motor, and wherein the connection for connecting the support frame to an overhead structure is mounted on the top portion of the arch.

29. The apparatus of claim 26, wherein the pipe piling includes a ring and the wrench flats are on said ring.

30. The apparatus of claim 29, wherein the ring includes at least four wrench flats equally spaced about the circumference of the ring.

31. The apparatus of claim 29, wherein the ring includes eight wrench flats equally spaced about the circumference of the ring.

32. The apparatus of claim 18, wherein the pipe pilling has a lower end that includes an augur for engaging the ground and screwing the pipe piling downwardly into the ground in response to rotation of the pipe piling by the drive head.

33. The apparatus of claim 32, wherein the pipe piling includes a ring and the wrench flats are provided on said ring.

* * * * *